US005461365A

United States Patent [19]

Schlager et al.

[11] Patent Number: 5,461,365

[45] Date of Patent: Oct. 24, 1995

[54] MULTI-HAZARD ALARM SYSTEM USING SELECTABLE POWER-LEVEL TRANSMISSION AND LOCALIZATION

[76] Inventors: Dan Schlager, 16 Barn Rd., Mill Valley, Calif. 94941; William B. Baringer, 6111 Westover Dr., Oakland, Calif. 94611

[21] Appl. No.: 330,901

[22] Filed: Oct. 27, 1994

[51] Int. Cl.[6] ..... G08B 21/00

[52] U.S. Cl. ..... 340/573; 340/539; 342/357; 342/450

[58] Field of Search ..... 340/539, 573, 340/990; 342/357, 450

[56] References Cited

U.S. PATENT DOCUMENTS

| | | | |
|---|---|---|---|
| 3,784,842 | 1/1974 | Kremer | 340/573 |
| 4,598,272 | 7/1986 | Cox | 340/573 |
| 4,656,463 | 4/1987 | Anders et al. | 340/521 |
| 4,675,656 | 6/1987 | Narcisse | 340/539 |
| 4,777,478 | 10/1988 | Hirsch et al. | 340/573 |
| 4,785,291 | 11/1988 | Hawthorne | 340/573 |
| 4,819,860 | 4/1989 | Hargrove et al. | 128/668 |
| 4,899,135 | 2/1990 | Ghahariiran | 340/573 |
| 4,952,928 | 8/1990 | Carroll et al. | 340/825.54 |
| 5,025,247 | 6/1991 | Banks | 340/574 |
| 5,043,702 | 8/1991 | Kuo | 340/539 |
| 5,043,736 | 8/1991 | Darnell et al. | 342/357 |
| 5,047,750 | 9/1991 | Hector | 340/573 |
| 5,086,391 | 2/1992 | Chambers | 364/413.02 |
| 5,115,223 | 5/1992 | Moody | 340/573 |

*Primary Examiner*—Glen Swann
*Attorney, Agent, or Firm*—Robert Buckley

[57] ABSTRACT

A personal alarm system includes a monitoring base station and one or more remote sensing units in two-way radio communication. An electronic handshake between the base station and each remote unit is used to assure system reliability. The remote units transmit at selectable power levels. In the absence of an emergency, a remote unit transmits at a power-conserving low power level. Received field strength is measured to determine whether a remote unit has moved beyond a predetermined distance from the base station. If the distance is exceeded, the remote unit transmits at a higher power level. The remote unit includes sensors for common hazards including water emersion, smoke, excessive heat, excessive carbon monoxide concentration, and electrical shock. The base station periodically polls the remote units and displays the status of the environmental sensors. The system is useful in child monitoring, for use with invalids, and with employees involved in activities which expose them to environmental risk. Alternative embodiments include a panic button on the remote unit for summoning help, and an audible beacon on the remote unit which can be activated from the base station and useful for locating strayed children. In another embodiment, the remote unit includes a Global Positioning System receiver providing location information for display by the base station.

34 Claims, 6 Drawing Sheets

MESSAGE FORMAT: REMOTE TO BASE

MESSAGE FORMAT: BASE TO REMOTE

MULTI-HAZARD ALARM SYSTEM USING SELECTABLE POWER-LEVEL TRANSMISSION AND LOCALIZATION

BACKGROUND OF THE INVENTION

1. Field of the Invention

This invention relates to personal alarm systems and in particular to such systems transmitting at a higher power level during emergencies.

2. Background Art

Personal alarm systems are well known in the art (see for example U.S. Pat. Nos. 4,777,478, 5,025,247, 5,115,223, 4,952,928, 4,819,860, 4,899,135, 5,047,750, 4,785,291, 5,043,702, and 5,086,391). These systems are used to maintain surveillance of children. They are used to monitor the safety of employees involved in dangerous work at remote locations. They are even used to find lost or stolen vehicles and strayed pets.

These systems use radio technology to link a remote transmitting unit with a base receiving and monitoring station. The remote unit is usually equipped with one or more hazard sensors and is worn or attached to the person or thing to be monitored. When a hazard is detected, the remote unit transmits to the receiving base station where an operator can take appropriate action in responding to the hazard.

The use of personal alarm systems to monitor the activities of children has become increasingly popular. A caretaker attaches a small remote unit, no larger than a personal pager, to an outer garment of a small child. If the child wanders off or is confronted with a detectable hazard, the caretaker is immediately notified and can come to the child's aid. In at least one interesting application, a remote unit includes a receiver and an audible alarm which can be activated by a small hand-held transmitter. The alarm is attached to a small child. If the child wanders away in a large crowd, such as in a department store, the caretaker actives the audible alarm which then emits a sequence of "beeps" useful in locating the child in the same way one finds a car at a parking lot through the use of an auto alarm system.

A number of novel features have been included in personal alarm systems. Hirsh et al., U.S. Pat. No. 4,777,478, provide for a panic button to be activated by the child, or an alarm to be given if someone attempts to remove the remote unit from the child's clothing. Banks, U.S. Pat. No. 5,025,247, teaches a base station which latches an alarm condition so that failure of the remote unit, once having given the alarm, will not cause the alarm to turn off before help is summoned. Moody, U.S. Pat. No. 5,115,223, teaches use of orbiting satellites and triangulation to limit the area of a search for a remote unit which has initiated an alarm. In U.S. Pat. No. 4,952,928 to Carroll et al., and in U.S. Pat. No. 4,819,860 to Hargrove et al., the apparatus provides for the remote monitoring of the vital signs of persons who are not confined to fixed locations.

Ghahariiran, U.S. Pat. No. 4,899,135, teaches a child monitoring device using radio or ultra-sonic frequency to give alarm if a child wanders out of range or falls into water. Hawthorne, U.S. Pat. 4,785,291, teaches a distance monitor for child surveillance in which a unit worn by the child includes a radio transmitter. As the child moves out of range, the received field strength, of a signal transmitted by the child's unit, falls below a limit and an alarm is given.

Clinical experience in the emergency rooms of our hospitals has taught that a limited number of common hazards account for a majority of the preventable injuries and deaths among our toddler age children. These hazards include the child's wandering away from a safe or supervised area, water emersion, fire, smoke inhalation, carbon monoxide poisoning and electrical shock. Child monitoring devices, such as those described above, have been effective in reducing the number of injuries and deaths related to these common preventable hazards.

However, considering the importance of our children's safety, there remains room for improvement of these systems. One such area for improvement relates to increasing the useful life of a battery used to power the remote unit of these toddler telemetry systems, as they have come to be called.

The remote unit is typically battery operated and, in the event of an emergency, continued and reliable transmission for use in status reporting and direction finding is of paramount importance. In other words, once the hazard is detected and the alarm given, it is essential that the remote unit continue to transmit so that direction finding devices can be used to locate the child.

The remote unit of most child monitoring systems is typically quite small and the available space for a battery is therefore quite limited. Despite recent advances in battery technology, the useful life of a battery is typically related to the battery size. For example, the larger "D" cell lasting considerably longer than the much smaller and lighter "AAA" cell. Though the use of very low power electronic circuits has made possible the use of smaller batteries, a battery's useful life is still very much a factor of its physical size, which, as stated above, is limited because of the small size of a typical remote unit. Therefore, additional efforts to reduce battery drain are important.

Given that much reliance is placed on the reliability of any child monitoring system, it would be desirable for the remote unit to transmit at a low power or not at all when no danger exists. In this way battery life is increased and system reliability is improved overall, since the hazards are usually the exception rather than the rule.

SUMMARY OF THE INVENTION

It is an object of the present invention to provide a personal alarm system in which the battery operated remote unit normally transmits at low power and switches to a higher power when the distance between the remote unit and base station exceeds a predetermined limit.

It is also an object of the present invention to provide such a system which includes sensors for the hazardous conditions typically confronting young children.

It is a further object of the present invention to provide such a personal alarm system which includes a periodic handshake exchange between the remote unit and base station to demonstrate that the system continues to be operational.

In accordance with the above objects and those that will become apparent below, a personal alarm system is provided, comprising:

a remote unit including radio transmitting means and radio receiving means;

the remote unit transmitting means being able to transmit at more than one power level and defining a higher power level;

a base station including radio transmitting means and radio receiving means;

the remote unit and the base station being in radio communication and defining a separation distance between the remote unit and the base station;

measuring means for determining whether the separation distance exceeds a predetermined limit;

means responsive to the measuring means for causing the remote unit transmitting means to transmit at the higher power level when the separation distance exceeds the limit; and alarm means for indicating when the separation distance exceeds the limit.

In one embodiment of the invention, the base station transmits a periodic polling signal and the remote unit monitors the field strength of the received polling signal. If the received field strength falls below a limit, corresponding to some maximum distance between the two devices, the remote unit transmits at high power. The signal transmitted at high power includes an indication that transmission is at high power. When this signal is received by the base station, an alarm is given. The remote unit also is equipped to detect one or more hazards.

In another embodiment of the invention, there are multiple remote units each able to identify itself by including a unit identification number in its transmitted signal. The remote unit is equipped to detect one or more hazards and to identify detected hazards in its transmission. The base station is able to display the transmitting unit identification number and the type of any detected hazard.

In another embodiment, the base station, rather than the remote unit, measures the field strength of the received remote unit transmission and instructs the remote unit to transmit at high power when the received field strength falls below a preset limit.

In another embodiment, the remote unit includes both visual and audible beacons which can be activated by the base station for use in locating the child.

In another embodiment, the remote unit includes a panic button which the child or concerned person can use to summon help.

In another embodiment, the base station includes the ability to initiate a phone call via the public telephone system, for example by initiating a pager message to alert an absent caretaker.

In another embodiment, the remote unit includes a global positioning system ("GPS") receiver which is activated if a hazard is detected or if the child wanders too far from the base station. The remote unit then transmits global positioning coordinates from the GPS receiver. These coordinates are received by the base station and used in locating the child. In an alternative embodiment, the remote unit is attached to a child, pet or vehicle and the GPS receiver is activated by command from the base station. The global positioning coordinates are then used by the base station operator to locate the remote unit.

In another embodiment, the remote unit is worn by an employee doing dangerous work at a remote location such as an electrical power lineman repairing a high voltage power line. The remote unit is equipped with a GPS receiver and an electrical shock hazard sensor and the remote unit will instantly transmit the workman's location in the event of electrical shock. The device will permit an emergency medical crew to rapidly find and give aid to the injured workman and possibly save a life.

It is an advantage of the present invention to periodically test system integrity by exchanging an electronic handshake and giving an alarm in the event of failure.

It is also an advantage of the present invention to prolong the remote unit battery life by transmission at low power in the absence of a defined emergency.

It is also an advantage of the present invention that the system is able to detect and give alarm for a number of common and dangerous hazards.

It is a further advantage of the present invention to permit rapid and precise location of the remote unit which is equipped with a GPS receiver.

DETAILED DESCRIPTION OF THE INVENTION

Figure 1:
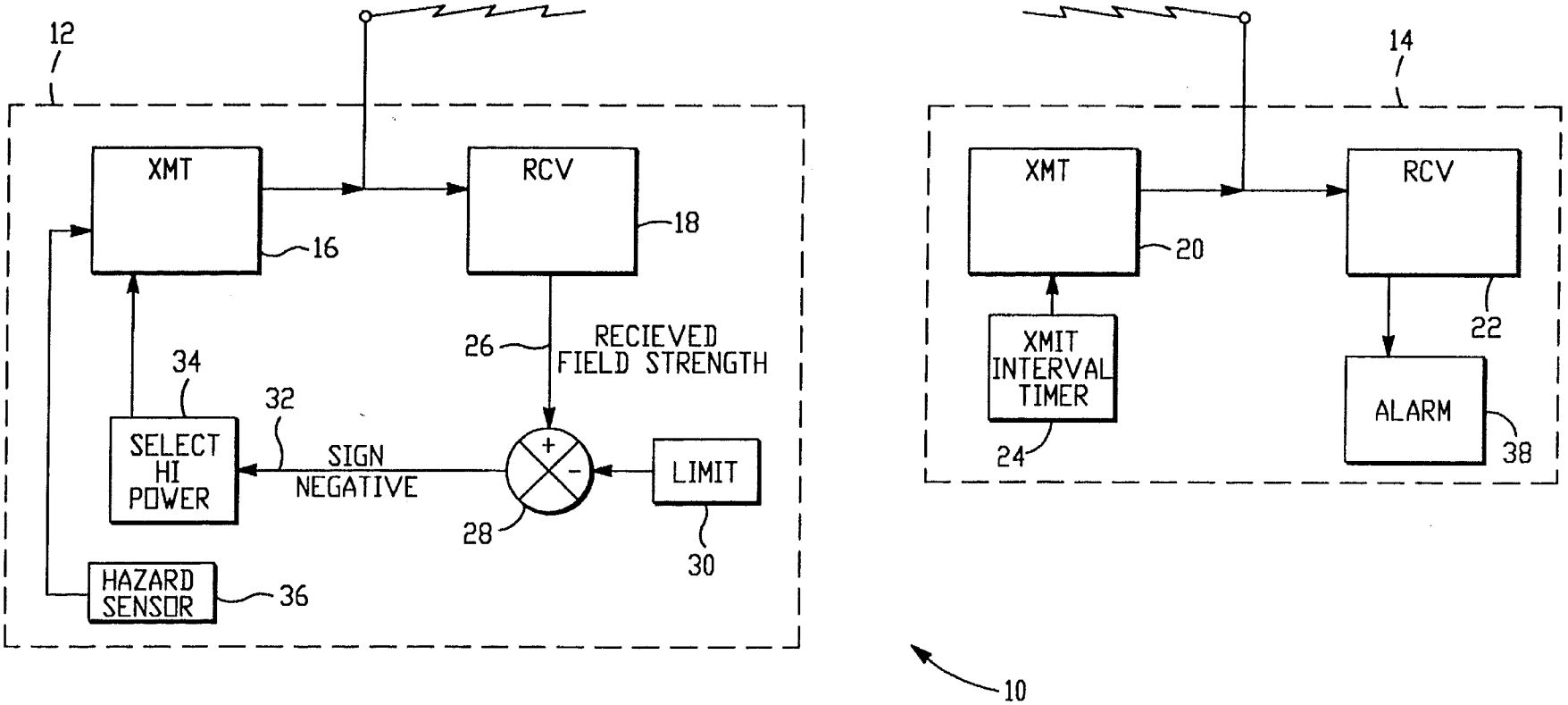
FIG. 1 is a block diagram of a personal alarm system in accordance with one embodiment of the present invention and transmitting at selectable power levels.

With reference to FIG. 1, there is shown a block diagram of a personal alarm system according to one embodiment of the present invention and depicted generally by the numeral 10. The personal alarm system 10 includes a remote unit 12 and a base station 14. The remote unit 12 has a radio transmitter 16 and a receiver 18, and the base station 14 has a radio transmitter 20 and a receiver 22. The transmitters 16, 20 and receivers 18, 22 are compatible for two-way radio communication between the remote unit 12 and the base station 14.

In a preferred embodiment, the base station 14 includes an interval timer 24 which causes the transmitter 20 to transmit at predetermined intervals. The receiver 18 of the remote unit 12 receives the signal transmitted by the base station 14 and causes the transmitter 16 to transmit a response to complete an electronic handshake.

The remote unit transmitter 16 is capable of transmitting at an energy conserving low-power level or at an emergency high-power level. When the distance between the remote unit 12 and the base station 14 exceeds a predetermined limit, the remote unit responds at the higher power level.

To accomplish the shift to the higher power level, the remote unit receiver 18 generates a signal 26 which is proportional to the field strength of the received signal, transmitted by the base station 14. The remote unit 12 includes a comparator 23 which compares the magnitude of the field strength signal 26 with a predetermined limit value 30 and generates a control signal 32.

The remote unit transmitter 16 is responsive to a circuit 34 for selecting transmission at either the low-power level or at the high-power level. The circuit 34 is connected to the control signal 32 and selects transmission at the low-power level when the received field strength equals or exceeds the limit value 30, and at the higher power level when the received field strength is less than the limit value 30. Alternatively, the remote unit transmitter 16 transmits at one of a selectable plurality of transmission power levels. In another alternative embodiment, transmission is selectable within a continuous range of transmission power levels.

Within an operating range of the personal alarm system 10, the field strength of the base station 14 transmitted signal when received at the remote unit 12 is inversely proportional to the fourth power (approximately) of the distance between the two units. This distance defines a 'separation distance,' and the predetermined limit value 30 is selected to cause transmission at the higher power level at a desired separation distance within the operating range.

In another embodiment, the remote unit 12 includes a hazard sensor 36 which is connected to the transmitter 16. The hazard sensor 36 is selected to detect one of the following common hazards, water emersion, fire, smoke, excessive carbon monoxide concentration, and electrical shock. In one embodiment, a detected hazard causes the remote unit 12 to transmit a signal reporting the existence of the hazardous condition at the moment the condition is detected. In another embodiment, the hazardous condition is reported when the response to the periodic electronic handshake occurs.

In one embodiment, the base station 14 includes an audible alarm 38 which is activated by the receiver 22. If the remote unit fails to complete the electronic handshake or reports a detected hazard or indicates it is out of range by sending an appropriate code, the base station alarm 38 is activated to alert the operator.

Figure 2:
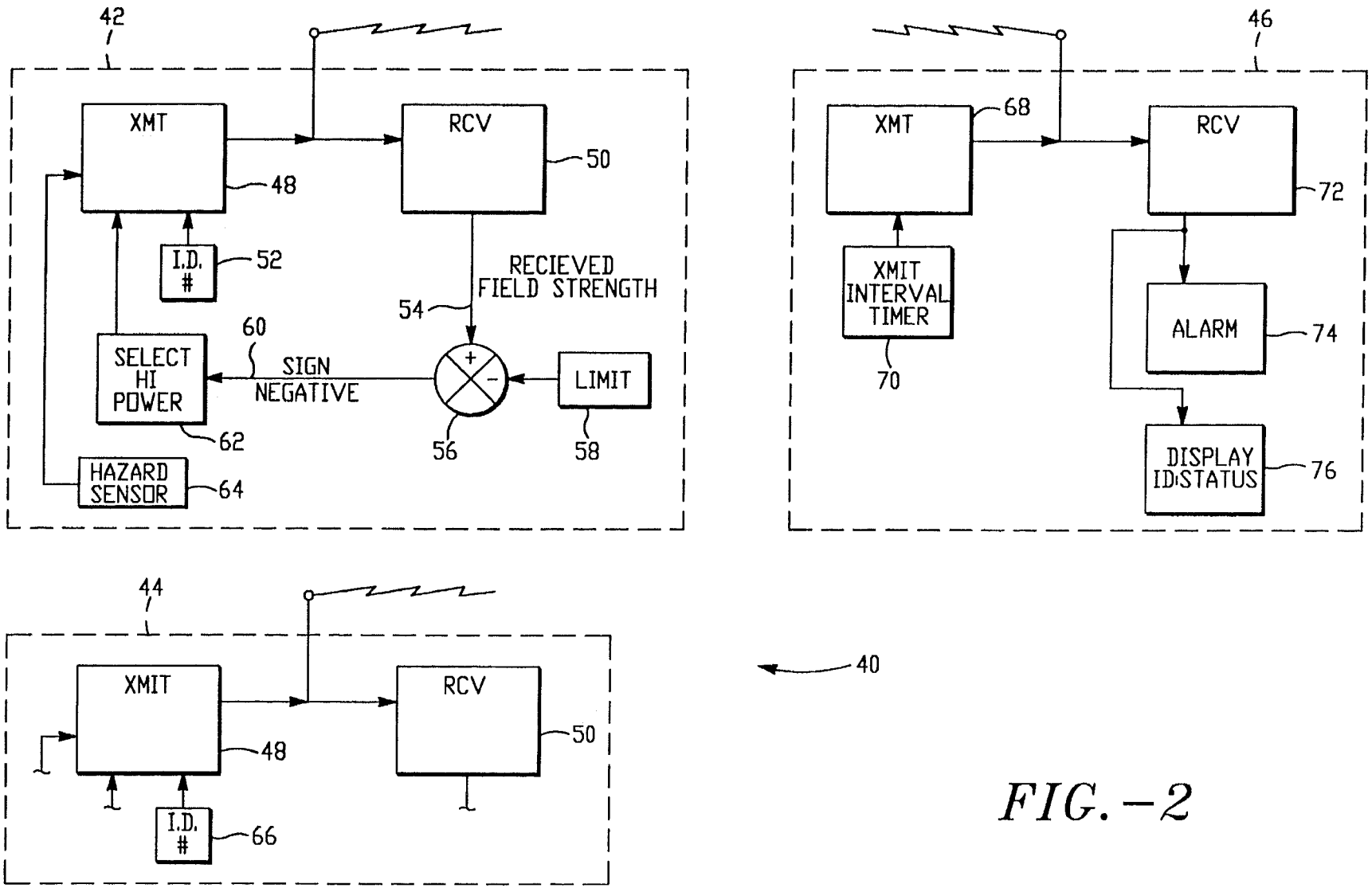
FIG. 2 is a block diagram of another embodiment of the personal alarm system illustrated in FIG. 1 including multiple remote units.

FIG. 2 is a block diagram illustrating another embodiment of the personal alarm system of the present invention. The alarm system is indicated generally by the numeral 40 and includes a first remote unit 42, a second remote unit 44 and a base station 46. The first remote unit 42 includes a transmitter 48, a receiver 50, an identification number 52, a received field strength signal 54, a comparator 56, a predetermined limit value 58, a control signal 60, a power level select circuit 62 and a hazard sensor 64.

The second remote unit 44 includes a separate identification number 66, but is otherwise identical to the first remote unit 42.

The base station 46 includes a transmitter 68, an interval timer 70, a receiver 72, an alarm 74 and an ID-Status display 76.

In one embodiment of the invention illustrated in FIG. 2, the radio transmission between the first remote unit 42 and the base station 46 includes the identification number 52. The transmission between the second remote unit 44 and the base station 46 includes the identification number 66. It will be understood by those skilled in the art that the system may include one or more remote units, each having a different identification number 52.

It will also be understood that each remote unit 42 may have a different predetermined limit value 58. The limit value 58 defines a distance between the remote unit 42 and the base station 46 beyond which the remote unit will transmit at its higher power level. If a number of remote units are being used to monitor a group of children, in a school playground for example, the limit values of each remote unit may be set to a value which will cause high power transmission if the child wanders outside the playground area. In other applications, the limit value 58 of each remote unit 42 may be set to a different value corresponding to different distances at which the individual remote units will switch to high power transmission.

In one embodiment, the base station 46 will provide an alarm 74 whenever a remote unit transmits at high power or reports the detection of a hazard. The identification number of the reporting remote unit and an indication of the type of hazard is displayed by the base station on the ID-Status display 76. This information can be used by the operator, for example a day-care provider, to decide what response is appropriate and whether immediate caretaker notification is required. If a child has merely wandered out of range, the provider may simply send an associate out to get the child and return her to the play area. On the other hand, a water emersion hazard indication should prompt immediate notification of caretakers and emergency personnel and immediate action by the day-care employees.

In another embodiment, the remote unit receiver 50 determines that the separation distance between the remote unit 42 and the base station 46 exceeds the predetermined threshold. The remote unit transmitter 48 transmits a code or status bit to indicate that fact.

In an embodiment illustrated in FIG. 1, the polling message transmitted periodically by the base station 14 is an RF carrier. The carrier frequency is transmitted until a response from the remote unit 12 is received or until a watchdog timer (not illustrated) times out, resulting in an alarm. The information contained in the remote unit response must include whether transmission is at low power or at high power, and whether a hazard has been detected, since the base station provides an alarm in either of these instances.

In an embodiment illustrated in FIG. 2, however, additional information must be reported and the advantages of a digitally formatted remote unit response will be apparent to those possessing an ordinary level of skill in the art.

Figure 3:
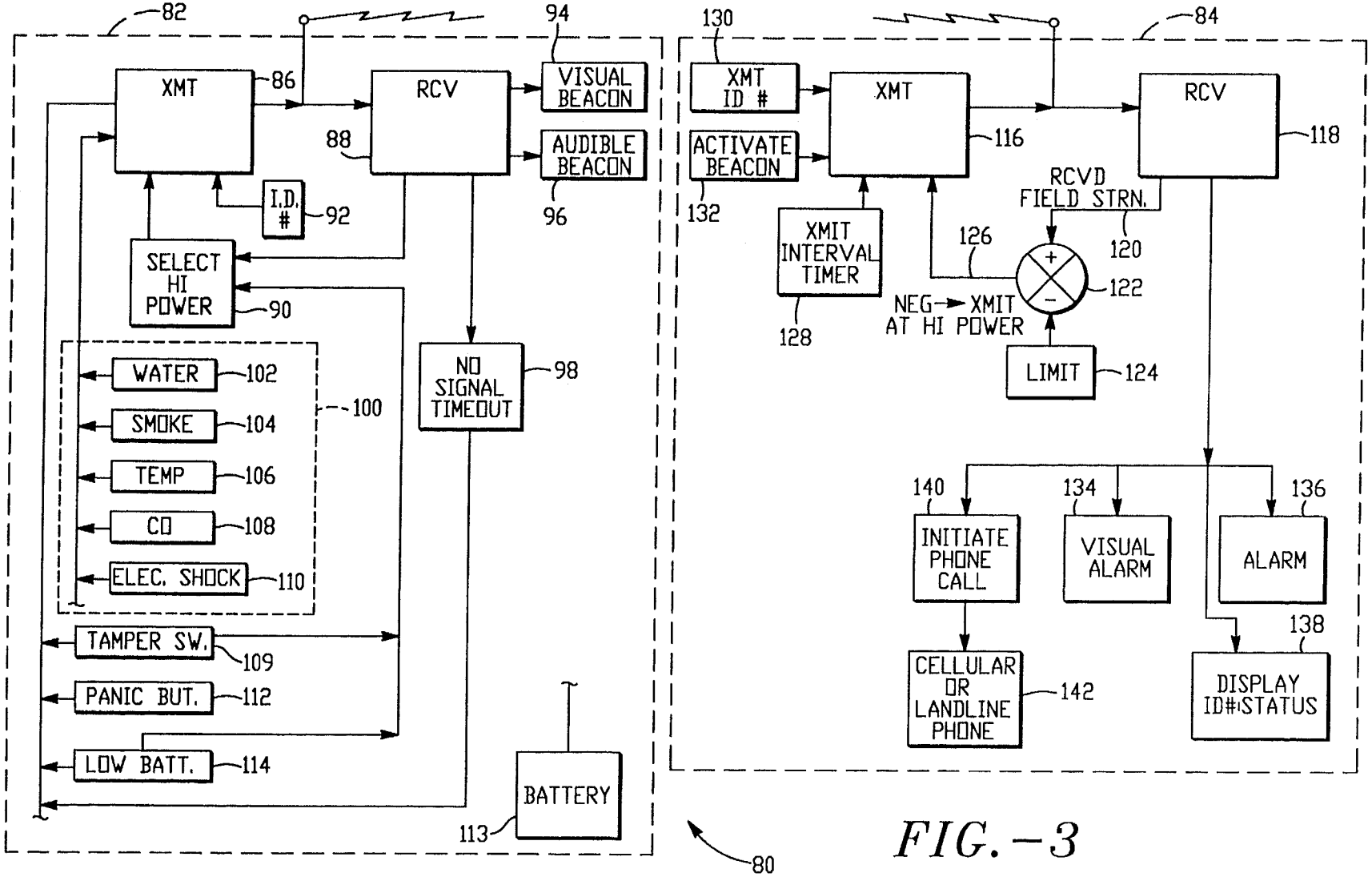
FIG. 3 is a block diagram illustrating another embodiment of the personal alarm system in accordance with the present invention.

FIG. 3 is a block diagram illustrating another embodiment of the personal alarm system in accordance with the present invention and generally indicated by the numeral 80. Personal alarm system 80 includes a remote unit 82 and a base station 84.

The remote unit 82 includes a transmitter 86, a receiver 88, a power level select circuit 90, an ID number 92, a visual beacon 94, an audible beacon 96, a watchdog timer 98, a plurality of hazard sensors 100 including a water emersion sensor 102, a smoke sensor 104, a heat sensor 106, a carbon monoxide sensor 108, a tamper switch 109, and an electrical shock sensor 110, an emergency switch ("panic button") 112, a battery 113, and a 'low battery power' sensor 114.

The base station 84 includes a transmitter 116, a receiver 118 which produces a received field strength signal 120, a comparator 122, a predetermined limit value 124, a comparator output signal 126, an interval timer 128, control signals 130 and 132, a visual alarm 134, an audible alarm 136, an ID and Status display 138, a circuit 140 for initiating a phone call and a connection 142 to the public telephone system.

The base station 84 and a plurality of the remote units 82 illustrated in the embodiment of FIG. 3 communicate using a digitally formatted message. One message format is used by the base station 84 to command a specific remote unit 82, and a second message format is used by a commanded remote unit 82 to respond to the base station 84. These message formats are illustrated in FIGS. 5 and 4, respectively.

Figure 4:
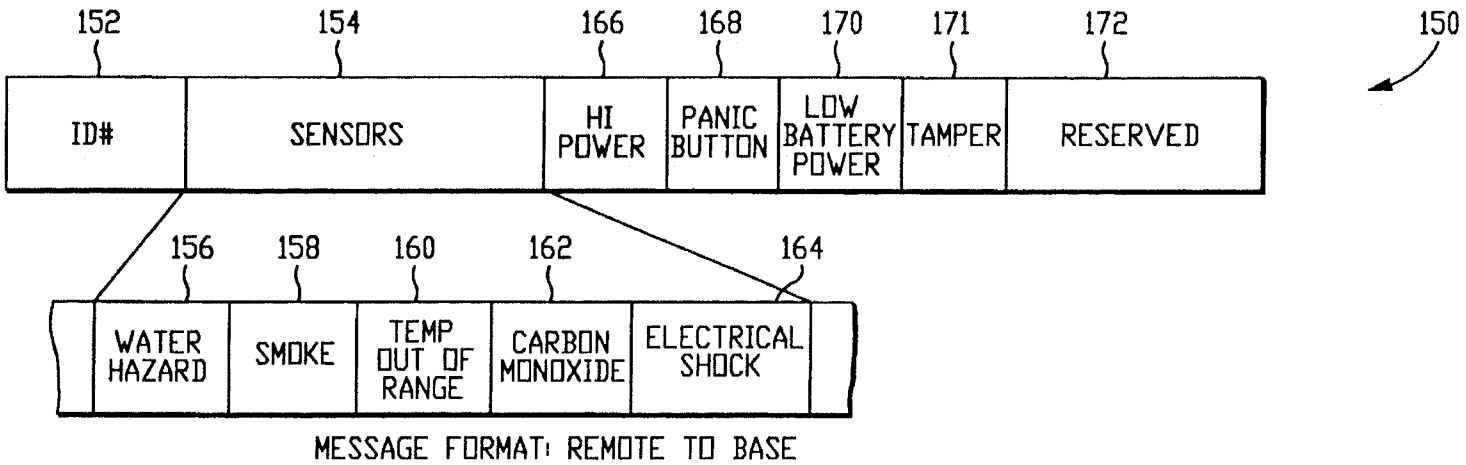
FIG. 4 is a pictorial diagram illustrating a preferred message format used by the personal alarm system illustrated in FIG. 2.

With reference to FIG. 4 there is shown a pictorial diagram of a preferred digital format for a response from a remote unit in a personal alarm system in accordance with the present invention, indicated generally by the numeral 150. The digital response format 150 includes a remote unit ID number 152, a plurality of hazard sensor status bits 154 including a water emersion status bit 156, a smoke sensor status bit 158, a heat sensor status bit 160, an excessive carbon monoxide concentration status bit 162, and an electrical shock status bit 164. The response 150 also includes a high power status bit, 166, a panic button status bit 168, a low battery power detector status bit 170, a tamper switch status bit 171, and bits reserved for future applications 172.

Figure 5:
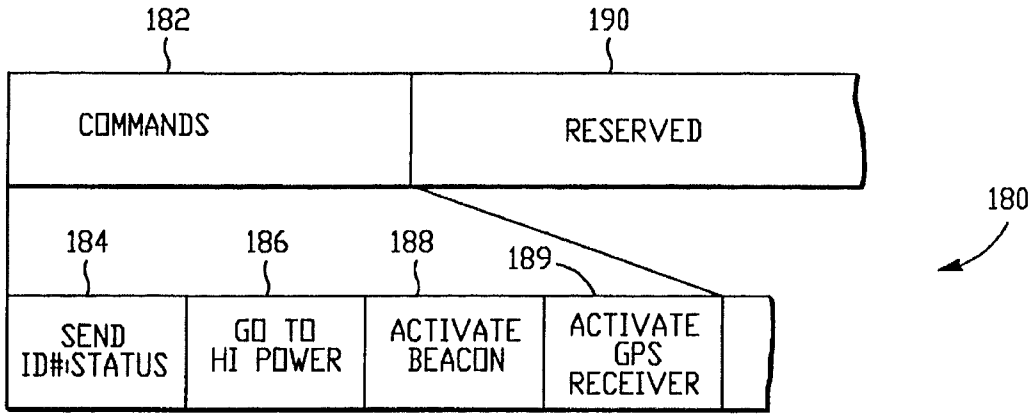
FIG. 5 is a pictorial diagram illustrating another preferred message format used by the personal alarm system illustrated in FIG. 2.
Figure 6:
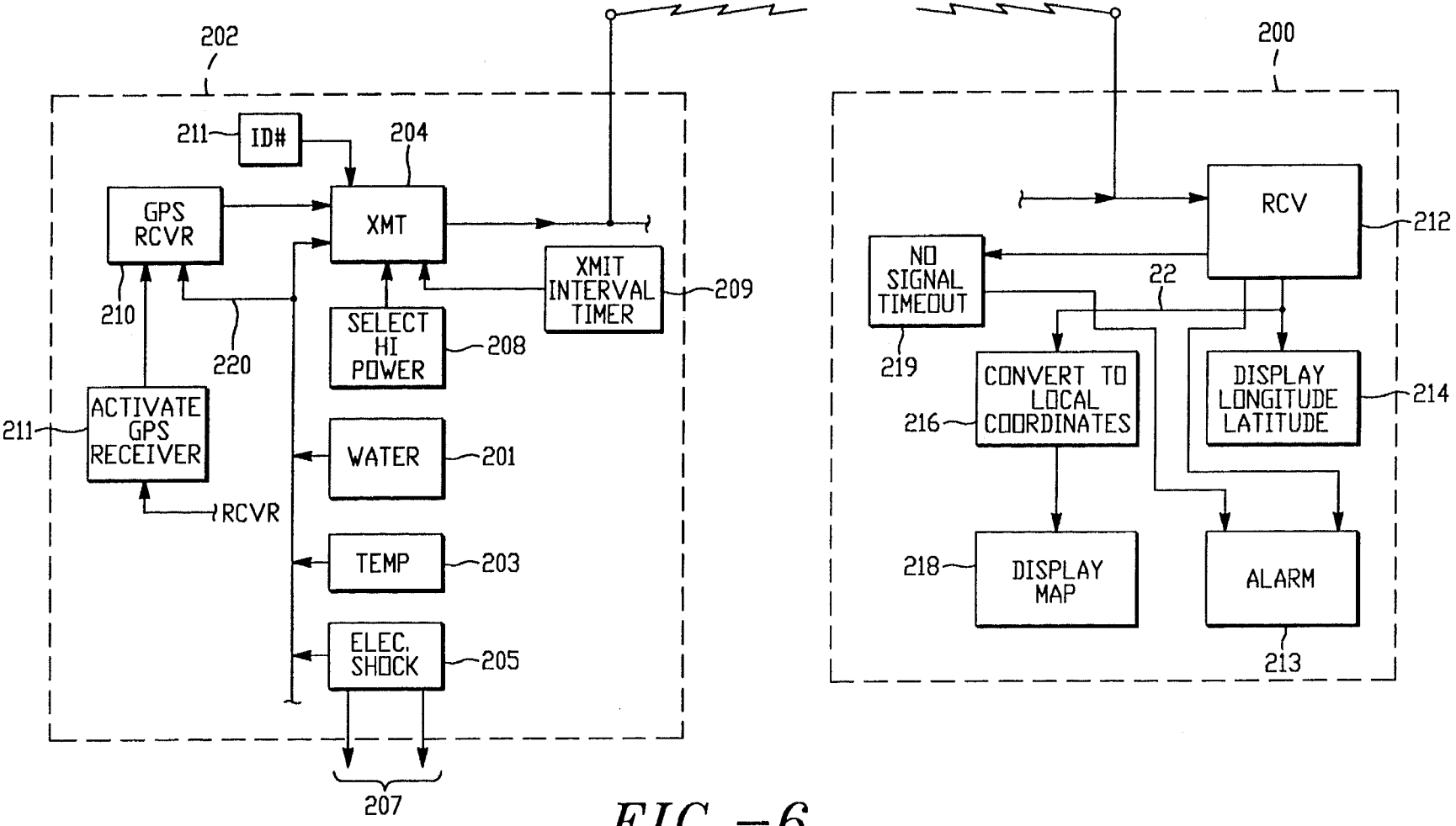
FIG. 6 is a block diagram illustrating an embodiment of the personal alarm system of the present invention using the Global Positioning System to improve remote unit location finding.

FIG. 5 is a pictorial diagram of a preferred digital format for a base station to remote unit transmission, generally indicated by the numeral 180. The digital message format 180 includes a command field 182 and a plurality of unassigned bits 190 reserved for a future application. The command field 182 includes a coded field of bits 184 used to command a specific remote unit to transmit its response message (using the format 150). The command field 182 also includes a single bit 186 used to command a remote unit, such as the embodiment illustrated in FIG. 3, to transmit at high power. The command field 182 includes command bit 188 used to command a remote unit to activate a beacon, such as the visual beacon 94 and the audible beacon 96 illustrated in FIG. 3. The command field 182 also includes command bit 189, used to command a remote unit to activate a GPS receiver, such as illustrated in FIG. 6.

In an alternative embodiment, the remote unit transmitter is adapted to transmit at one of a plurality of transmission power levels and the single command bit 186 is replaced with a multi-bit command sub-field for selection of a power level. In another embodiment, the remote unit transmitter is adapted to transmit at a power level selected from a continuum of power levels and a multi-bit command sub-field is provided for the power level selection.

Again with respect to FIG. 3, the Base station 84 periodically polls each remote unit 82 by transmitting a command 180 requiring the remote unit 82 to respond with message format 150. The polling is initiated by the interval timer 128 which causes the base station transmitter 116 to transmit the outgoing message 180. The numerals 150 and 180 are used to designate both the format of a message and the transmitted message. A specific reference to the format or the transmitted message will be used when necessary for clarity. As is common in the communications industry, the message will sometimes be referred to as a 'signal,' at other times as a 'transmission,' and as a 'message;' a distinction between these will be made when necessary for clarity.

The message 180 is received by all remote units and the remote unit to which the message is directed (by the coded field 184) responds by transmitting its identification number 152 and current status, bits 154–170. The remote unit identification number 92 is connected to the transmitter 86 for this purpose.

In the embodiment illustrated in FIG. 3, the function of measuring received field strength to determine whether a predetermined separation distance is exceeded is performed in the base station 84. The base station receiver 118 provides a received field strength signal 120 which is connected to the comparator 122. The predetermined limit value 124 is also connected to the comparator 122 which provides a comparator output signal 126. If the received field strength 120 is less than the limit value 124, the comparator output signal 126 is connected to assert the "go-to-high-power" command bit 186 in the base unit 84 outgoing message 180. The limit value 124 is selected to establish the predetermined separation distance beyond which transmission at high power is commanded.

In one embodiment, the selection of the limit value 124 is accomplished by the manufacturer by entering the value into a read-only memory device. In another embodiment, the manufacturer uses manually operated switches to select the predetermined limit value 124. In another embodiment, the manufacturer installs jumper wires to select the predetermined limit value 124. In yet another embodiment, the user selects a predetermined limit value 124 using manually operated switches.

The remote unit transmitter 86 is capable of transmitting at a power-conserving lower power level and also at an emergency higher power level. Upon receiving a message 180 including the remote unit identification number 184, the remote unit receiver passes the "go-to-high-power" command bit 186 to the power level select circuit 90 which is connected to command the remote unit transmitter 86 to transmit a response 150 at the higher power level. The response 150 includes status bit 166 used by the remote unit 82 to indicate that it is transmitting at high power.

In one embodiment, the remote unit includes the watchdog timer 98 (designated a 'No Signal Timeout') which is reset by the receiver 88 each time the remote unit 82 is polled. If no polling message 180 is received within the timeout period of the watchdog timer 98, the remote unit transmitter 86 is commanded to transmit a non-polled message 150.

In one embodiment of the invention, the remote unit 82 includes a manually operated switch ("panic button") 112 which is connected to the transmitter 86 to command the transmission of a non-polled message 150. The panic button status bit 168 is set in the outgoing message 150 to indicate to the base station 84 that the panic button has been depressed. Such a button can be used by a child or invalid or other concerned person to bring help.

In another embodiment, the remote unit includes a tamper switch 109 which is activated if the remote unit is removed from the child, or is otherwise tampered with. The activation of the tamper switch 109 causes the remote unit to transmit a code or status bit to the base unit to identify the cause of the change of status ('Tamper' status bit 171 illustrated in FIG. 4). In one related alternative, the remote unit transmits at the higher power level when the switch is activated by removal of the remote unit from the child's person.

In another embodiment, the remote unit 82 includes a circuit 114 which monitors battery power. The circuit 114 is connected to initiate a non-polled message 150 if the circuit determines that battery power has fallen below a predetermined power threshold. The message 150 will include the "low-battery-power" status bit 170. In an alternative embodiment, a low battery power level will initiate a remote unit transmission at the higher power level (see FIG. 3).

In the embodiment illustrated in FIG. 3, the remote unit 82 includes several hazard sensors 100. These sensors are connected to report the detection of common hazards and correspond to the sensor status bits 154 in the remote unit response message 150.

In another embodiment of the present invention, the base station receiver 118 is connected to a visual alarm 134 and an audible alarm 136 and will give an alarm when a message 150 is received which includes any hazard sensor report 154 or any of the status bits 166–170.

The base station 84 also includes the status and ID display 138 used to display the status of all remote units in the personal alarm system 80.

In another embodiment of the personal alarm system 80, the base station 84 includes a circuit 140 for initiating a telephone call when an emergency occurs. The circuit 140 includes the telephone numbers of persons to be notified in the event of an emergency. A connection 142 is provided to a public landline or cellular telephone system. The circuit 140 can place calls to personal paging devices, or alternatively place prerecorded telephone messages to emergency personnel, such as the standard "911" number.

FIG. 6 is a partial block diagram illustrating an embodiment of the invention having a base station 200 and at least one remote unit 202. The partially illustrated remote unit 202 includes a transmitter 204, hazard sensors 201, 203, 205, a circuit 208 for causing the transmitter to transmit at a higher power level, a transmit interval timer 209, and a Global Positioning System ('GPS') receiver 210. The partially illustrated base station 200 includes a receiver 212, an alarm 213, a display 214 for displaying global positioning coordinates of longitude and latitude, a circuit 216 for converting the global positioning coordinates into predefined local coordinates, a map display 218 for displaying a map in the local coordinates and indicating the location of the remote unit 202, and a watchdog timer 219.

In a preferred embodiment of the alarm system, the remote unit transmitter 204 is connected to receive the global positioning coordinates from the GPS receiver 210 for transmission to the base station 200.

The GPS receiver 210 determines its position and provides that position in global positioning coordinates to the transmitter 204. The global position coordinates of the remote unit 202 are transmitted to the base station 200. The base station receiver 212 provides the received global positioning coordinates on line 222 to display 214 and to coordinate converter 216. The display 214 displays the global coordinates in a world-wide coordinate system such as longitude and latitude.

In one embodiment of the alarm system, the coordinate converter 216 receives the global positioning coordinates from line 222 and converts these into a preferred local coordinate system. A display 218 receives the converted coordinates and displays the location of the remote unit 202 as a map for easy location of the transmitting remote unit 202.

In another embodiment of the alarm system, the GPS receiver 210 includes a low power standby mode and a normal operating mode. The GPS receiver 210 remains in the standby mode until a hazard is detected and then switches to the normal operating mode.

In another embodiment of the alarm system, the GPS receiver 210 remains in the standby mode until commanded by the base station 200 to enter the normal operating mode (see command bit 189 illustrated in FIG. 5).

In another embodiment of the alarm system, the remote unit transmitter 204 is connected to the hazard sensors 201–205 for transmission of detected hazards. The base station receiver 212 is connected to activate the alarm 213 upon detection of a hazard.

In one embodiment, a conventional electrical shock sensor 205 includes a pair of electrical contacts 207 which are attached to the skin of a user for detection of electrical shock.

In another embodiment, the remote unit 202 includes a transmit interval timer 209 and an ID number 211. The timer 209 is connected to cause the remote unit to transmit the ID number at predetermined intervals. The base station 200 includes a watchdog timer 219 adapted to activate the alarm 213 if the remote unit fails to transmit within the prescribed interval.

In another embodiment of the alarm system, the remote unit 202 includes a carbon monoxide concentration sensor (see 108 of FIG. 3) having an output signal connected to activate a sensor status bit (see 162 of FIG. 4) for transmission to the base station 200.

Figure 7:
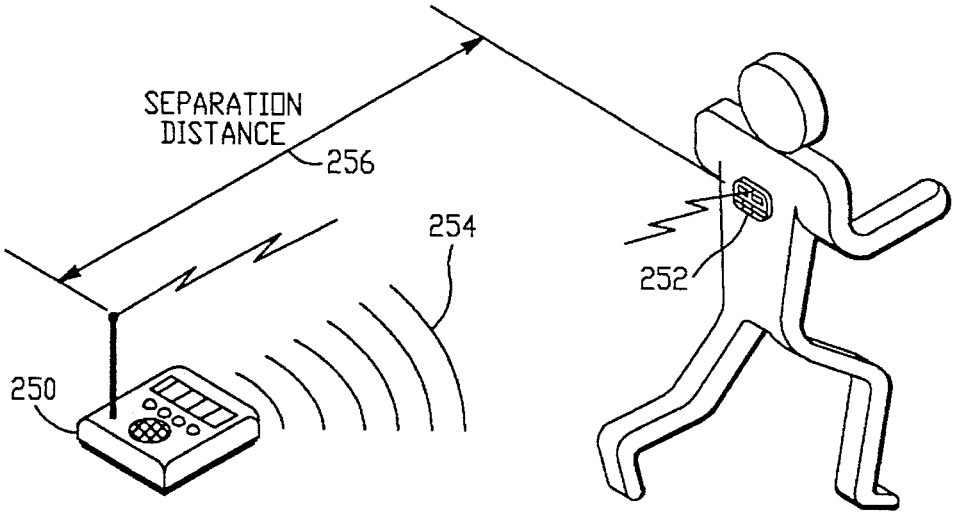
FIG. 7 is a pictorial diagram illustrating a base station and remote unit of the personal alarm system of FIG. 1, in a typical child monitoring application.
Figure 8:
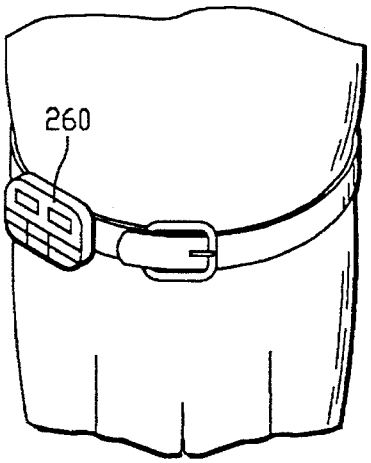
FIG. 8 is a pictorial diagram illustrating a remote unit in accordance with the present invention being worn at the waist.
Figure 9:
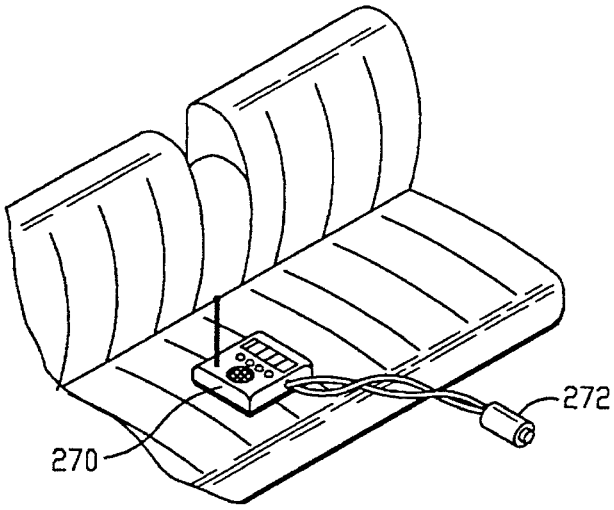
FIG. 9 is a pictorial diagram illustrating a mobile base station in accordance with the present invention for operation from a vehicle electrical system.
Figure 10:
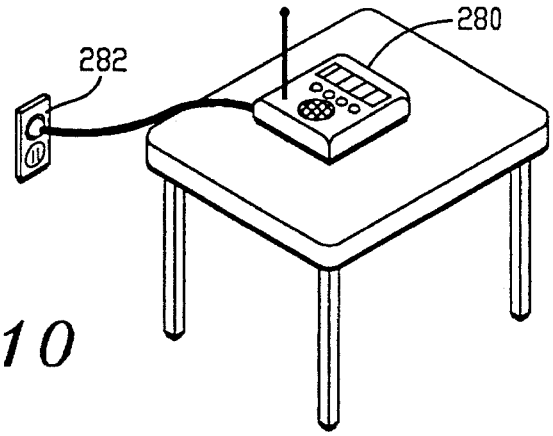
FIG. 10 is a pictorial diagram illustrating a base station in accordance with the present invention being operated from ordinary household power.

FIGS. 7–10 are pictorial illustrations of alternative embodiments of the personal alarm system of the present invention. FIG. 7 illustrates a base station 250 in two-way radio communication with a remote unit 252 worn by a child. The child is running away from the base station 250 such that the separation distance 256 has exceeded the preset threshold. The base station has determined that an alarm should be given, and an audible alarm 254 is being sounded to alert a responsible caretaker. FIG. 8 illustrates a remote unit worn at the waist of a workman whose location and safety are being monitored. FIG. 9 illustrates a mobile base station 270 equipped with a cigarette lighter adapter 272 for operation in a vehicle. FIG. 10 illustrates a base station 280 adapted for operation from ordinary household current 282.

While the foregoing detailed description has described several embodiments of the personal alarm system in accordance with this invention, it is to be understood that the above description is illustrative only and not limiting of the disclosed invention. Thus, the invention is to be limited only by the claims as set forth below.

What is claimed is:

1. A personal alarm system, comprising:

a remote unit including radio transmitting means and radio receiving means;

the remote unit transmitting means being able to transmit at more than one power level and defining a higher power level;

a base station including radio transmitting means and radio receiving means;

the remote unit and the base station being in radio communication and defining a separation distance between the remote unit and the base station;

measuring means for determining whether the separation distance exceeds a predetermined limit;

means responsive to the measuring means for causing the remote unit transmitting means to transmit at the higher power level when the separation distance exceeds the limit; and alarm means for indicating when the separation distance exceeds the limit.

2. The personal alarm system as set forth in claim 1, wherein the remote unit includes the measuring means and the means for causing radio transmission at the higher power level.

3. The personal alarm system as set forth in claim 2, wherein the alarm means further includes means for the remote unit to communicate to the base station that transmission is at the higher power level, and base station means responsive to the communication for providing an alarm.

4. The personal alarm system as set forth in claim 1, wherein the base station includes the measuring means and the alarm means, and wherein the means for causing transmission at the higher power level further includes means for the base station to communicate to the remote unit that transmission is to be at the higher power level, and remote unit means responsive to the communication for enabling transmission at the higher power level.

5. The personal alarm system as set forth in claim 1, wherein the measuring means includes one radio receiving means defining a received signal strength, the one radio receiving means including threshold means for determining whether the field strength falls below a predetermined threshold, the measuring means defining an equivalence between the field strength falling below the threshold, and the separation distance exceeding the limit.

6. The personal alarm system as set forth in claim 1, wherein the remote unit further includes at least one sensor means for detecting a personal hazard, the remote unit also including means for communicating a detected hazard to the base station, and the base station including means responsive to the communication for giving an alarm.

7. The personal alarm system as set forth in claim 6, wherein the remote unit includes a plurality of hazard sensors and means for communicating detected hazards to the base station.

8. The personal alarm system as set forth in claim 6, further including a plurality of remote units, each remote unit including means for communicating identification information to the base station, and the base station including means responsive to the communication for recognizing a communication as received from a particular remote unit.

9. The personal alarm system as set forth in claim 6, wherein the sensor means detects immersion in water.

10. The personal alarm system as set forth in claim 6, wherein the sensor means detects smoke.

11. The personal alarm system as set forth in claim 6, wherein the sensor means defines a normal range and detects temperatures outside the normal range.

12. The personal alarm system as set forth in claim 6, wherein the sensor means defines a dangerous concentration of carbon monoxide and detects the presence of carbon monoxide exceeding the dangerous concentration.

13. The personal alarm system as set forth in claim 6, wherein the sensor means defines and detects a dangerous electrical shock hazard.

14. The personal alarm system as set forth in claim 1, wherein the remote unit includes manually operated switch means and means for communicating the switch operation to the base station, and the base station includes means responsive to the communication for giving an alarm.

15. The personal alarm system as set forth in claim 1, wherein the remote unit includes battery means for deriving operating power, and further includes means for determining that the power level of the battery means has fallen below a predetermined power level, the remote unit also including means for communicating the low battery power to the base station, and the base station including means responsive to the communication for giving an alarm.

16. The personal alarm system as set forth in claim 15, wherein the remote unit includes means for enabling transmission at the higher power level when low battery power is detected.

17. The personal alarm system as set forth in claim 1, wherein the base station includes means for initiating a phone call for alerting a caretaker upon the occurrence of a predetermined event.

18. The personal alarm system as set forth in claim 1, wherein the base station includes means for obtaining operating power from a vehicle electrical system.

19. The personal alarm system as set forth in claim 1, including means for the remote unit giving a loud audible alarm upon command from the base station.

20. The personal alarm system as set forth in claim 1, wherein the remote unit is contained within a tamper resistant enclosure and is battery operated, the enclosure having means for attachment to clothing.

21. The personal alarm system as set forth in claim 20, further including means for giving an alarm if the remote unit is tampered with or is removed from the clothing.

22. The personal alarm system as set forth in claim 1; wherein the base station includes means for deriving operating power from a standard household electrical outlet.

23. The personal alarm system as set forth in claim 1, wherein the base station transmits to the remote unit at predetermined intervals and the remote unit includes means for giving an alarm if the base station fails to transmit within an interval slightly longer than the predetermined interval.

24. The personal alarm system as set forth in claim 1, wherein the base station transmits at predetermined intervals, and the remote unit transmitting means switches to the higher power level if a base station transmission is not received within an interval slightly longer than the predetermined interval.

25. A personal alarm system, comprising:

a remote unit including remote radio transmitting means and remote radio receiving means;

a base station including local radio transmitting means and local radio receiving means;

the remote unit and the base station being in radio communication;

the remote unit including global positioning system receiver means for providing the location of the remote unit in global positioning system coordinates;

the remote unit further including at least one sensor means for detecting a personal hazard, the at least one sensor means providing a first output signal;

the remote radio transmitting means connected to receive the global positioning coordinates for radio transmission of the coordinates, and the remote radio transmitting means defining a sensor status and connected to receive the first output signal for radio transmission of the sensor status;

the base station including means responsive to global positioning coordinates received by the local radio receiving means for displaying the coordinates; and the base station including means responsive to the sensor status received by the local receiving means for displaying the sensor status, and for giving an alarm, whereby, a detectable emergency will cause the emergency to be identified to a base station operator and the base station will display the coordinates of the transmitting remote unit.

26. The personal alarm system as set forth in claim 25, further defining the global positioning receiver means having a low power standby mode and a normal operating mode, and the alarm system further including means for causing the global positioning receiver means to switch from the standby mode to the normal operating mode upon the detection of a hazard.

27. The personal alarm system as set forth in claim 26, including means for causing the global positioning receiver means to switch between the low power standby and the normal operating modes upon command from the base station.

28. The personal alarm system as set forth in claim 25, wherein the at least one sensor means includes means for detecting emersion of the remote unit in water.

29. The personal alarm system as set forth in claim 25, wherein the at least one sensor means includes means for detecting excessive heat.

30. The personal alarm system as set forth in claim 25, wherein the at least one sensor means includes means for detecting electrical shock, said sensor means equipped with a pair of electrical contacts for attachment to the body of a user for measuring an electrical potential between the attached contacts.

31. The personal alarm system as set forth in claim 25, further defining a dangerous carbon monoxide concentration and including a carbon monoxide sensor having an output signal, the remote radio transmitting means being connected to receive the carbon monoxide sensor output signal for radio transmission of a carbon monoxide sensor status.

32. The personal alarm system as set forth in claim 25, wherein the remote unit transmitting means is able to transmit at more than one power level and defining a higher power level, and defining a separation distance between the remote unit and the base station, and the alarm system including measuring means for determining whether the separation distance exceeds a predetermined limit and means responsive to the measuring means for causing the remote unit transmitting means to transmit at the higher power level when the separation distance exceeds the limit, and alarm means for indicating when the separation distance exceeds the limit.

33. The personal alarm system as set forth in claim 25, wherein the remote unit transmits an ID to the base station at predetermined intervals and wherein the base station includes means for giving an alarm if the remote unit fails to transmit the ID within an interval slightly longer than the predetermined interval.

34. A personal alarm system, comprising:

a remote unit including remote radio transmitting means and remote radio receiving means;

a base station including local radio transmitting means and local radio receiving means;

the remote unit and the base station being in radio communication;

the remote unit including electrical shock sensor means and providing an output signal to the remote :radio transmitting means, the sensor including a pair of electrical contacts for connection to the body of a user; and the remote radio transmitting means being adapted to transmit when the sensor detects an excessive electrical potential between the electrical contacts;

the base station including means responsive to the transmission from the remote unit for giving an alarm, whereby an alarm can be given if the electrical shock hazard is detected.

* * * * *